US011181015B2

(12) United States Patent
Huerta Ortiz et al.

(10) Patent No.: US 11,181,015 B2
(45) Date of Patent: Nov. 23, 2021

(54) OIL CONTROL VALVE FOR CAM PHASER

(71) Applicant: GM Global Technology Operations LLC, Detroit, MI (US)

(72) Inventors: Rolando Huerta Ortiz, Grandville, MI (US); Michael E. McCarroll, Kentwood, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 253 days.

(21) Appl. No.: 16/420,550

(22) Filed: May 23, 2019

(65) Prior Publication Data

US 2020/0370450 A1 Nov. 26, 2020

(51) Int. Cl.

| | |
|---|---|
| ***F01L 9/10*** | (2021.01) |
| ***F01L 1/053*** | (2006.01) |
| *F01L 1/344* | (2006.01) |

(52) U.S. Cl.

CPC ..... *F01L 9/10* (2021.01); *F01L 1/0532* (2013.01); *F01L 2001/3443* (2013.01); *F01L 2001/34433* (2013.01)

(58) Field of Classification Search

CPC ..... F01L 9/10; F01L 9/00; F01L 9/04; F01L 1/344; F01L 1/3442; F01L 1/0532; F01L 1/02; F01L 1/047; F01L 1/46; F01L 2001/3443; F01L 2001/34433; F01L 2001/3445; F01L 2001/34469; F01L 2001/34426; F01L 5/04; F01L 2009/0478; F16K 11/10; F16K 11/0716; F16K 15/044; Y10T 137/87169; Y10T 137/87241

USPC ..... 123/90.15, 90.17

See application file for complete search history.

(56) References Cited

U.S. PATENT DOCUMENTS

| | | | | |
|---|---|---|---|---|
| 2017/0342870 | A1* | 11/2017 | Huerta Ortiz | F16K 15/044 |
| 2018/0073402 | A1* | 3/2018 | Smith | F01L 1/34409 |
| 2018/0363514 | A1* | 12/2018 | Stanhope | F01L 1/3442 |
| 2019/0107014 | A1* | 4/2019 | Smith | F01L 1/3442 |
| 2019/0153910 | A1* | 5/2019 | Asahi | F01L 1/3442 |
| 2019/0368387 | A1* | 12/2019 | Mitsutani | F01L 1/3442 |
| 2020/0141290 | A1* | 5/2020 | Asahi | F01L 1/047 |

* cited by examiner

*Primary Examiner* — Devon C Kramer
*Assistant Examiner* — Kelsey L Stanek
(74) *Attorney, Agent, or Firm* — Vivacqua Crane, PLLC

(57) ABSTRACT

An oil control valve for controlling a cam phaser includes a valve housing, a recirculation housing, a spool guide, a spool, a first and second recirculation valve, and a one-way inlet valve. The valve housing has a pressure inlet port, a first bore having a first inner surface, a first port, and a second port. The recirculation housing has a first slot, a second slot, a second bore having a second inner surface, and a first outer surface. A first recirculation valve is disposed in the first slot of the recirculation housing. A second recirculation valve is disposed in the second slot of the recirculation housing. The one-way inlet valve disposed in the pressure inlet port. The recirculation housing and spool are each slidingly disposed to have a first, second, and third modes.

20 Claims, 8 Drawing Sheets

OIL CONTROL VALVE FOR CAM PHASER

INTRODUCTION

The present disclosure relates generally to an oil control valve and more particularly to an oil control valve for a cam phaser of an internal combustion engine.

Internal combustion engines include features that have an increasing effect on improving fuel economy while maintaining or improving power output. Many of the features have added cost and complexity to engine design, manufacturing, and engine controls. One such feature is variable camshaft phasing which provides the engine calibration the ability to access more efficient valve timing. Controlling the camshaft phaser includes providing oil pressure from an oil pump to a phaser oil control valve to which cam phase-angle commands are given during the operation of the engine. However, current oil control valves fall short in functionality when certain inputs to the oil control valve are restricted, especially at low speeds.

Accordingly, there is a need in the art for an oil control valve that provides additional functionality while requiring reduced input.

SUMMARY

An oil control valve for controlling a cam phaser is provided. The oil control valve comprising a valve housing, a recirculation housing, a spool guide, a spool, a first and second recirculation valve, and a one-way inlet valve. The valve housing has a pressure inlet port, a first bore having a first inner surface, a first port, and a second port. The recirculation housing has a first slot, a second slot, a second bore having a second inner surface, and a first outer surface. The recirculation housing is disposed within the first bore of the valve housing. The spool guide has a third port, a fourth port, a fifth port, a sixth port, a seventh port, a second outer surface, a third bore having a third inner surface, a first flat surface, and a second flat surface. The spool guide is disposed within the second bore of the recirculation housing. The spool has an eighth port, a ninth port, a tenth port, and an eleventh port, and wherein the spool is slidingly disposed within the third bore of the spool guide. The first recirculation valve has a first selectable one-way member. The first recirculation valve is disposed in the first slot of the recirculation housing. The second recirculation valve has a second selectable one-way member. The second recirculation valve is disposed in the second slot of the recirculation housing. The one-way inlet valve disposed in the pressure inlet port. The recirculation housing and spool are each slidingly disposed to have a first, second, and third modes.

In one example of the present disclosure, the first slot of the recirculation housing includes a first recirculation switch. The second slot of the recirculation housing includes a second recirculation switch. The recirculation housing is disposed in a first position. The first recirculation switch prevents the first recirculation valve from opening. The recirculation housing is disposed in a second position wherein the second recirculation switch prevents the second recirculation valve from opening.

In another example of the present disclosure, the first recirculation valve selectively provides one-way oil communication from the first port to the second port and the second recirculation valve selectively provides one-way oil communication from the second port to the first port.

In yet another example of the present disclosure, the first and second recirculation valves each include a frame member and a resilient member. The frame member includes an angled portion disposed between a first port portion and a second port portion. The resilient member is disposed in one of a first and a second position. The first position of the resilient member allows oil flow from the first port portion to the second port portion. The second position of the resilient member blocks oil flow from the second port portion to the first port portion.

In yet another example of the present disclosure, the first and second recirculation valves each include a base portion and a first and second resilient members. The base portion has a rectangle shape forming a channel. The first resilient member has a first end extending from a first side of the base portion. The second resilient member has a first end extending from a second side of the base portion opposite the first side. A second end of the first resilient member selectively contacts a second end of the second resilient member.

In yet another example of the present disclosure, the first mode of the recirculation housing, the spool guide, and spool includes the pressure inlet port in communication with the first port, the second port in communication with a sump, and the second port is in communication with the first port via the first recirculation valve.

In yet another example of the present disclosure, the second mode of the recirculation housing, the spool guide, and spool includes the pressure inlet port in communication with the first port and the second port in communication with the first port via the first recirculation valve.

In yet another example of the present disclosure, the third mode of the recirculation housing, the spool guide, and spool includes the pressure inlet port in communication with the second port and the first port in communication with the second port via the second recirculation valve.

In yet another example of the present disclosure, the recirculation housing, the spool guide, and spool include a fourth mode including the pressure inlet port in communication with the second port, the first port in communication with the sump, and the first port in communication with the second port via the second recirculation valve.

In yet another example of the present disclosure, the recirculation housing, the spool guide, and spool include a fifth mode including first port in communication with the second port via the first recirculation valve and the second port in communication with the first port via the second recirculation valve.

In yet another example of the present disclosure, the recirculation housing, the spool guide, and spool include a fifth mode including the pressure inlet port in communication with the first port and the second port, the first port in communication with the second port via the first recirculation valve, and the second port in communication with the first port via the second recirculation valve.

Another oil control valve for controlling a cam phaser is provided. The oil control valve includes a valve housing, a recirculation housing, a spool guide, a spool, a first and second recirculation valve, and a one-way inlet valve. The valve housing has a pressure inlet port, a first bore having a first inner surface, a first port, and a second port. The recirculation housing has a first slot, a second slot, a second bore having a second inner surface, and a first outer surface. The recirculation housing is disposed within the first bore of the valve housing. The spool guide has a third port, a fourth port, a fifth port, a sixth port, a seventh port, a second outer surface, a third bore having a third inner surface, and a first flat surface, and a second flat surface. The spool guide is disposed within the second bore of the recirculation housing. The spool has an eighth port, a ninth port, a tenth port, and an eleventh port. The spool is slidingly disposed within the third bore of the spool guide. The first recirculation valve has a first selectable one-way member. The first recirculation valve is disposed in the first slot of the recirculation housing and selectively provides one-way oil communication from the first port to the second port. The second recirculation valve has a second selectable one-way member. The second recirculation valve is disposed in the second slot of the recirculation housing and selectively provides one-way oil communication from the second port to the first port. The one-way inlet valve disposed in the pressure inlet port. The recirculation housing and spool are each slidingly disposed to have a first, second, third, and fourth modes. The first slot of the recirculation housing includes a first recirculation switch. The second slot of the recirculation housing includes a second recirculation switch. The recirculation housing is disposed in a first position wherein the first recirculation switch prevents the first recirculation valve from opening. The recirculation housing is disposed in a second position wherein the second recirculation switch prevents the second recirculation valve from opening.

In one example of the present disclosure, the first and second recirculation valves each include a frame member and a resilient member. The frame member includes an angled portion disposed between a first port portion and a second port portion. The resilient member is disposed in one of a first and a second position. The first position of the resilient member allows oil flow from the first port portion to the second port portion. The second position of the resilient member blocks oil flow from the second port portion to the first port portion.

In another example of the present disclosure, the first and second recirculation valves each include a base portion and a first and second resilient members. The base portion has a rectangle shape forming a channel. The first resilient member has a first end extending from a first side of the base portion. The second resilient member has a first end extending from a second side of the base portion opposite the first side. A second end of the first resilient member selectively contacts a second end of the second resilient member.

In yet another example of the present disclosure, the first mode of the recirculation housing, the spool guide, and spool includes the pressure inlet port in communication with the first port, the second port in communication with a sump, and the second port is in communication with the first port via the first recirculation valve.

In yet another example of the present disclosure, the second mode of the recirculation housing, the spool guide, and spool includes the pressure inlet port in communication with the first port and the second port in communication with the first port via the first recirculation valve.

In yet another example of the present disclosure, the third mode of the recirculation housing, the spool guide, and spool includes the pressure inlet port in communication with the second port and the first port in communication with the second port via the second recirculation valve.

In yet another example of the present disclosure, the fourth mode the recirculation housing, the spool guide, and spool includes the pressure inlet port in communication with the second port, the first port in communication with the sump, and the first port in communication with the second port via the second recirculation valve.

In yet another example of the present disclosure, the recirculation housing, the spool guide, and spool include a fifth mode including first port in communication with the second port via the first recirculation valve and the second port in communication with the first port via the second recirculation valve.

In yet another example of the present disclosure, the recirculation housing, the spool guide, and spool include a fifth mode including the pressure inlet port in communication with the first port and the second port, the first port in communication with the second port via the first recirculation valve, and the second port in communication with the first port via the second recirculation valve.

Yet another oil control valve for controlling a cam phaser is provided. The oil control valve includes a valve housing, a recirculation housing, a spool guide, a spool, a first and second recirculation valve, and a one-way inlet valve. The valve housing has a pressure inlet port, a first bore having a first inner surface, a first port, and a second port. The recirculation housing has a first slot, a second slot, a second bore having a second inner surface, and a first outer surface. The recirculation housing is disposed within the first bore of the valve housing. The spool guide has a third port, a fourth port, a fifth port, a sixth port, a seventh port, a second outer surface, a third bore having a third inner surface, a first flat surface, and a second flat surface. The spool guide is disposed within the second bore of the recirculation housing. The spool has an eighth port, a ninth port, a tenth port, and an eleventh port. The spool is slidingly disposed within the third bore of the spool guide. The first recirculation valve has a first selectable one-way member. The first recirculation valve is disposed in the first slot of the recirculation housing and selectively provides one-way oil communication from the first port to the second port. The second recirculation valve has a second selectable one-way member. The second recirculation valve is disposed in the second slot of the recirculation housing and selectively provides one-way oil communication from the second port to the first port. The one-way inlet valve disposed in the pressure inlet port.

The recirculation housing, and spool are each slidingly disposed to have a first, second, third, and fourth modes. The first slot of the recirculation housing includes a first recirculation switch, the second slot of the recirculation housing includes a second recirculation switch, the recirculation housing is disposed in a first position wherein the first recirculation switch prevents the first recirculation valve from opening, the recirculation housing is disposed in a second position wherein the second recirculation switch prevents the second recirculation valve from opening, the first mode of the recirculation housing, the spool guide, and spool includes the pressure inlet port in communication with the first port, the second port in communication with a sump, and the second port is in communication with the first port via the first recirculation valve, the second mode of the recirculation housing, the spool guide, and spool includes the pressure inlet port in communication with the first port and the second port in communication with the first port via the first recirculation valve, the third mode of the recirculation housing, the spool guide, and spool includes the pressure inlet port in communication with the second port and the first port in communication with the second port via the second recirculation valve, and the fourth mode including the pressure inlet port in communication with the second port, the first port in communication with the sump, and the first port in communication with the second port via the second recirculation valve.

In one example of the present disclosure, the first and second recirculation valves each include a frame member and a resilient member. The frame member includes an angled portion disposed between a first port portion and a second port portion. The resilient member is disposed in one of a first and a second position. The first position of the resilient member allows oil flow from the first port portion to the second port portion. The second position of the resilient member blocks oil flow from the second port portion to the first port portion.

In another example of the present disclosure, the first and second recirculation valves each include a base portion and a first and a second resilient members. The base portion has a rectangle shape forming a channel. The first resilient member has a first end extending from a first side of the base portion. The second resilient member has a first end extending from a second side of the base portion opposite the first side. A second end of the first resilient member selectively contacts a second end of the second resilient member.

In yet another example of the present disclosure, the recirculation housing, the spool guide, and spool include a fifth mode including first port in communication with the second port via the first recirculation valve and the second port in communication with the first port via the second recirculation valve.

In yet another example of the present disclosure, the recirculation housing, the spool guide, and spool include a fifth mode including the pressure inlet port in communication with the first port and the second port, the first port in communication with the second port via the first recirculation valve, and the second port in communication with the first port via the second recirculation valve.

The above features and advantages and other features and advantages of the present disclosure are readily apparent from the following detailed description when taken in connection with the accompanying drawings.

BRIEF DESCRIPTION OF THE DRAWINGS

The drawings described herein are for illustration purposes only and are not intended to limit the scope of the present disclosure in any way.

DESCRIPTION

The following description is merely exemplary in nature and is not intended to limit the present disclosure, application, or uses.

Figure 1:
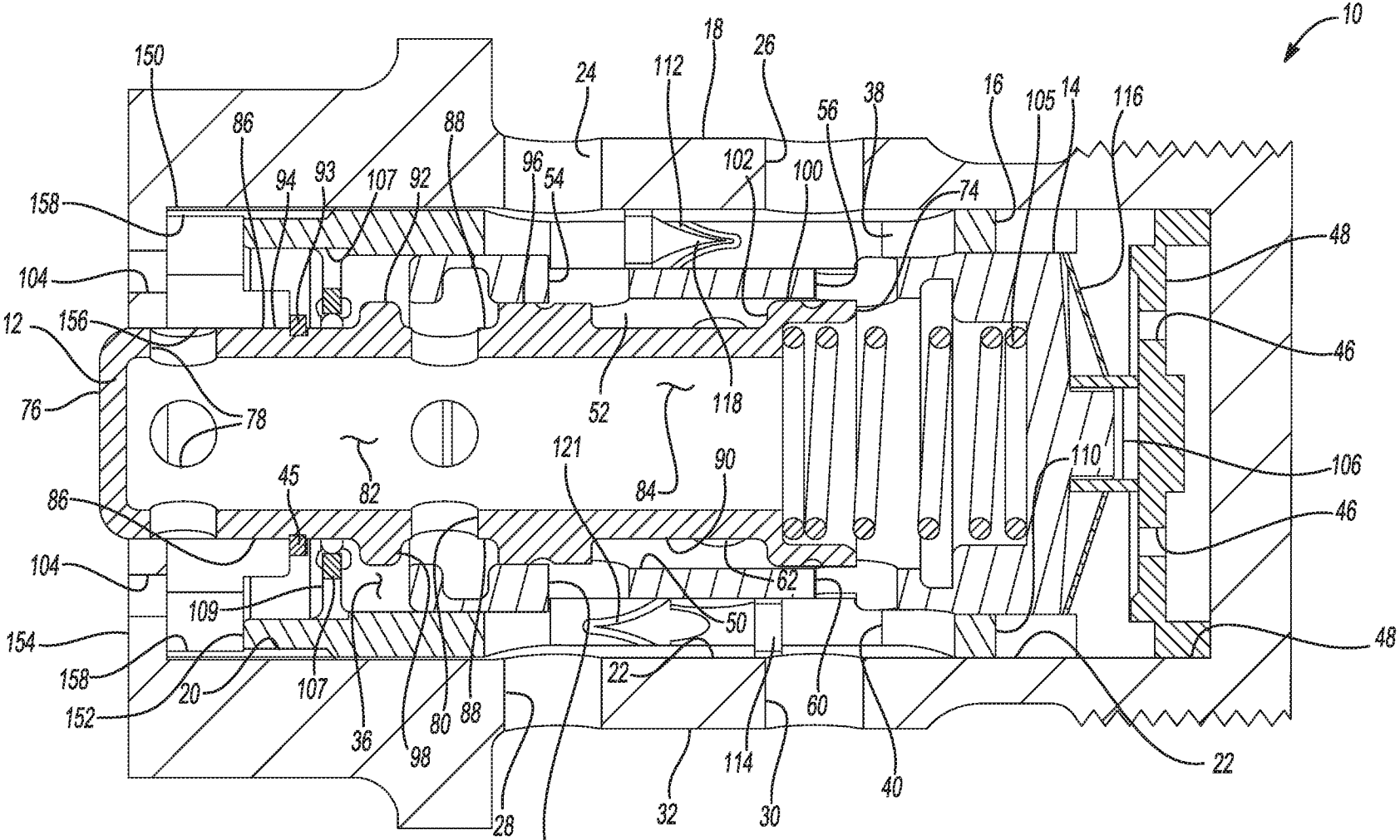
FIG. 1, is a cutaway view of an oil control valve according to the principles of the present disclosure.
Figure 3:
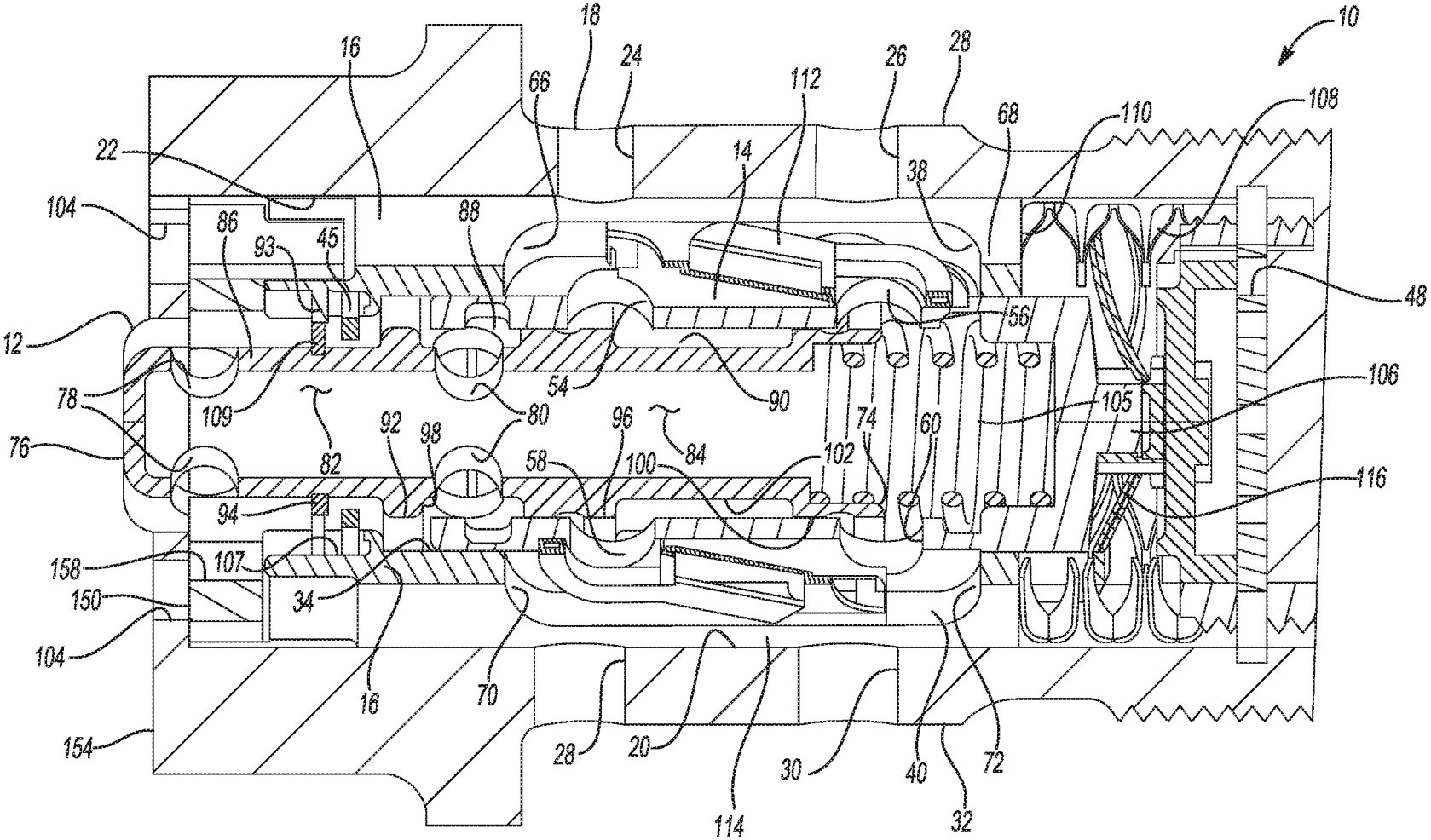
FIG. 3, is a cutaway view of an oil control valve according to the principles of the present disclosure.
Figure 5A:
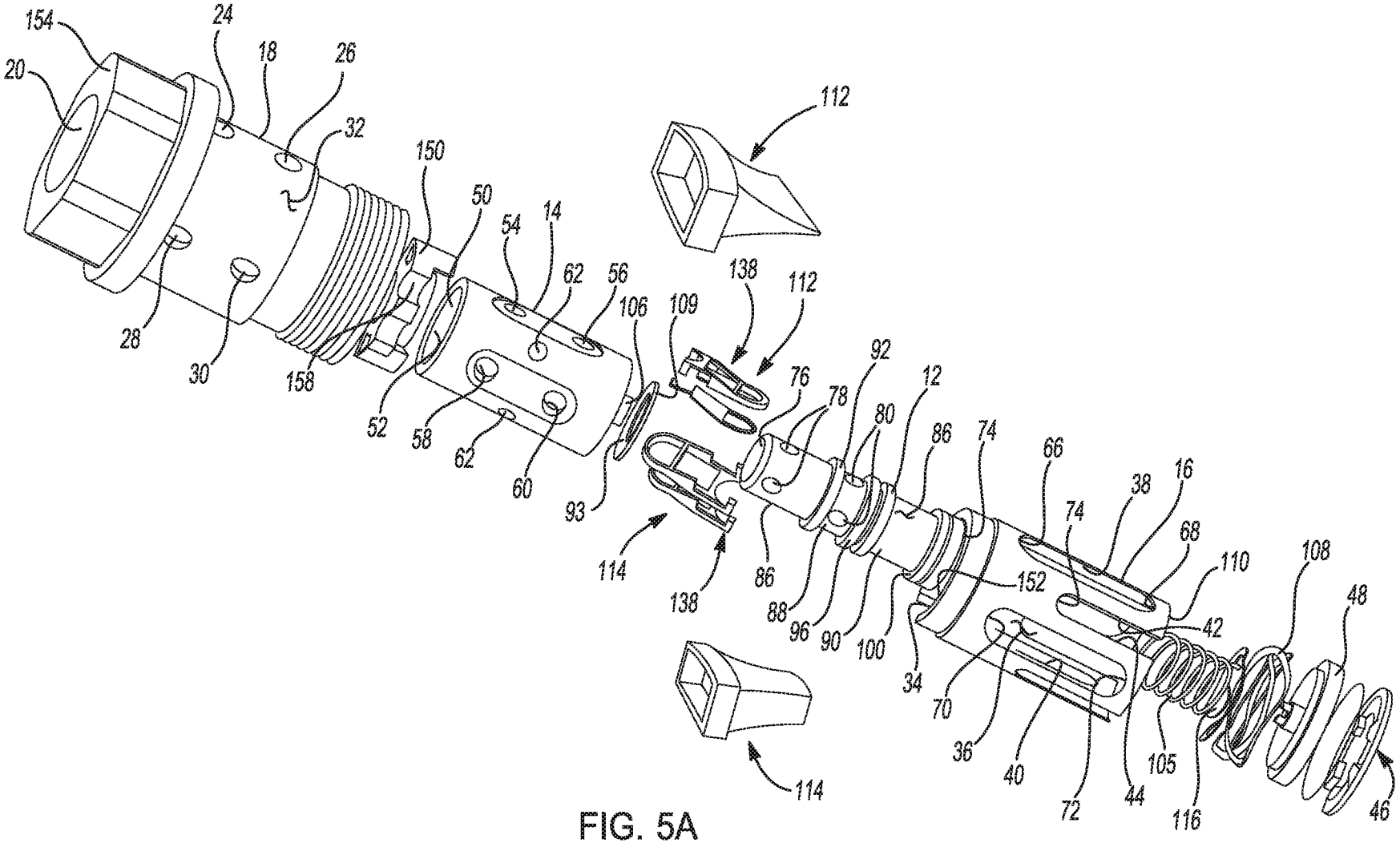
FIG. 5A is a exploded view of a oil control valve according to the principles of the present disclosure.
Figure 5B:
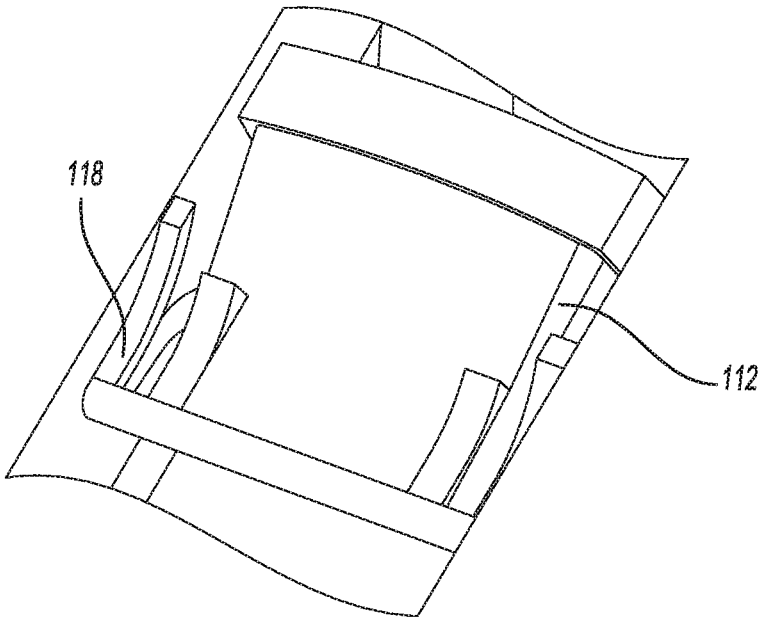
FIG. 5B is a perspective view of a selectable one-way valve according to the principles of the present disclosure.
Figure 5C:
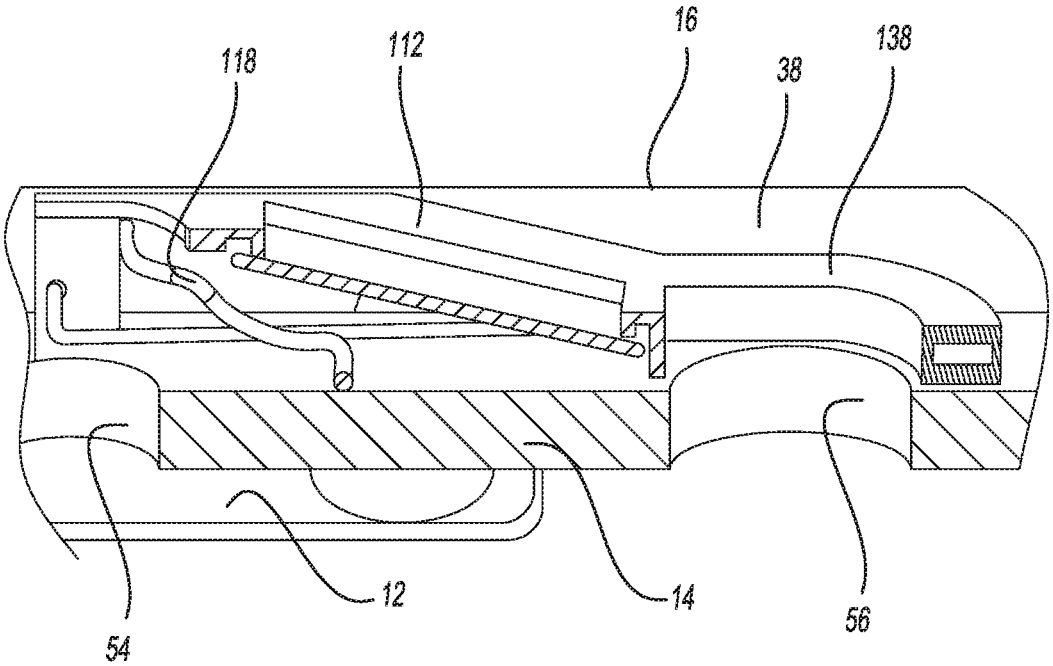
FIG. 5C is a perspective view of a selectable one-way valve according to the principles of the present disclosure.

Referring to FIGS. 1, 3, and 5A, an oil control valve 10 is illustrated and will now be described. The oil control valve 10 shown is particularly helpful when used to control the indexing of a cam phaser of the valvetrain of an internal combustion engine. However, other applications for the oil control valve 10 are made evident throughout the present disclosure. The oil control valve 10 shown in FIGS. 1 and 3 include a spool 12, a spool guide 14, and a recirculation housing 16 each disposed in a valve housing 18. More particularly, the valve housing 18 includes a central bore 20 defined by an inner surface 22, a first port 24, a second port 26, a third port 28, and a fourth port 30. Each of the first port 24, second port 26, third port 28, and fourth port 30 allow for communication between the central bore 20 of the valve housing 18 and the exterior of the housing 32.

The recirculation housing 16 includes a central bore 34 defined by an inner surface 36, a first slot 38, a second slot 40, a third slot 42, and a flange 45. The recirculation housing 16 is disposed in the central bore 20 on the inner surface 22 of the valve housing 18 in a manner that aligns the first slot 38 with the first and second ports 24, 26 to allow for communication between the first and second ports 24, 26 on the interior of the valve housing 18. The second slot 40 aligns with the third and fourth ports 28, 30 to allow for communication between the third and fourth ports 28, 30. The third slot 42 has an open end 44 proximate a first end 110 of the recirculation housing 16 to allow for selective communication between an inlet pressure port 46 and at least one of the first, second, third, and fourth ports 24, 26, 28, 30 of the valve housing 18. The flange 45 is an inwardly protruding flange 45 extending radially inward from the inner surface 22 of the recirculation housing 16.

Figure 9:
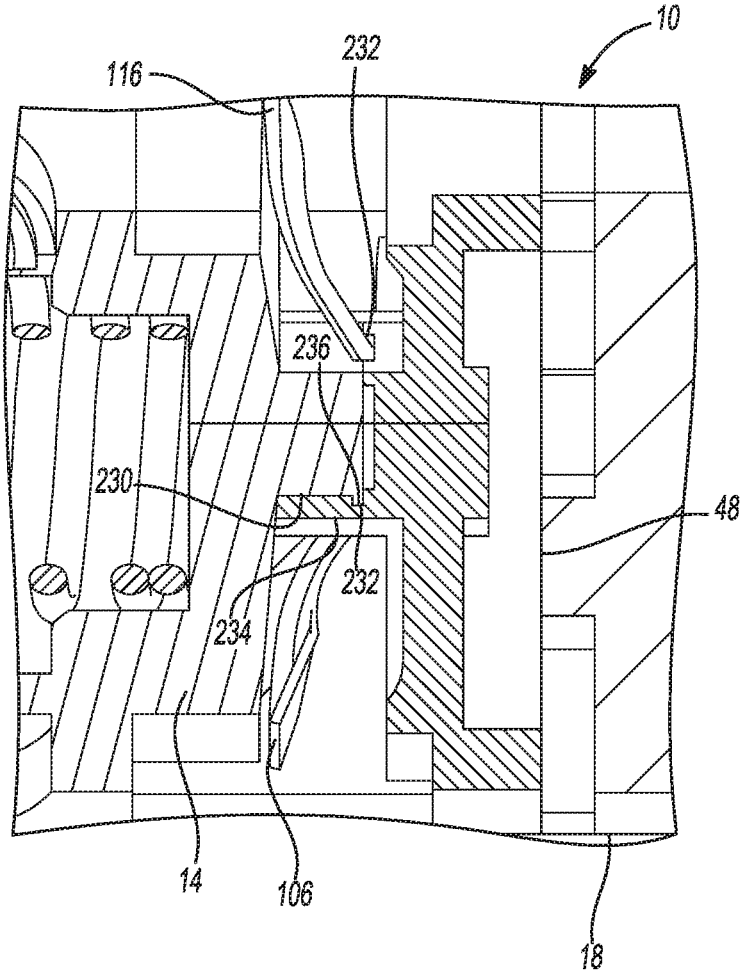
FIG. 9 is a sectional view of a portion of an oil control valve according to the principles of the present disclosure.

The spool guide 14 is disposed in the central bore 34 of the recirculation housing 16 and is fixed at a first end 106 to the valve housing 18 through an inlet port seat 48. As shown in more detail in FIG. 9, the first end 106 of the spool guide 14 includes an axial protrusion 230 having a pair of tabs 232. The inlet port seat 48 includes a socket portion 234 having a groove 236. The axial protrusion 230 and tabs 232 are disposed in the socket portion 234 and the groove 236, respectively.

The spool guide 14 includes a central bore 50 defined by an inner surface 52, a first port 54, a second port 56, a third port 58, a fourth port 60, and a fifth port 62. More particularly, the first port 54 is aligned for communication with a first end 66 the first slot 38 of the recirculation housing 16.

The second port 56 is aligned for communication with a second end 68 of the first slot 38 of the recirculation housing 16. The third port 58 is aligned for communication with a first end 70 of the second slot 40 of the recirculation housing 16. The fourth port 60 is aligned for communication with a second end 72 of the second slot 40 of the recirculation housing 16.

The spool 12 of the oil control valve 10 is slidingly disposed in the central bore 50 of the spool guide 14. The spool 12 has an open first end 74, a closed second end 76, a first port 78, a second port 80, an central bore 82 defined by an inner surface 84, a first outer surface 86, a second outer surface 88, and a third outer surface 90. The first outer surface 86 is separated from the second outer surface 88 by a first seal portion 92 forming a first chamber 94. The second outer surface 88 is separated from the third outer surface 90 by a second seal portion 96 forming a second chamber 98. A third seal portion 100 disposed proximate the open first end 74 of the spool 12 cooperates with the third outer surface 90 to form a third chamber 102. A retainer or spring clip 93 is disposed on the first outer surface 86 of the spool 12. The spool 12 is positioned relative to the recirculation housing 16 such that the flange 45 of the recirculation housing is disposed axially between the spring clip 93 and the first seal portion 92 of the spool. Thus, as the spool 12 translates axially in the valve housing 18 the spring clip 93 of the spool 12 imparts a force on the flange 45 of the recirculation housing 16 and translates the recirculation housing relative to the valve housing 18. The spring clip 93 includes a plurality of ports 109 to allow for oil venting to an exhaust port 104 of the valve housing 18. Also, the flange 45 of the recirculation housing 16 includes a plurality of ports 107 to allow for oil venting to the exhaust port 104 of the valve housing 18.

Figure 6A:
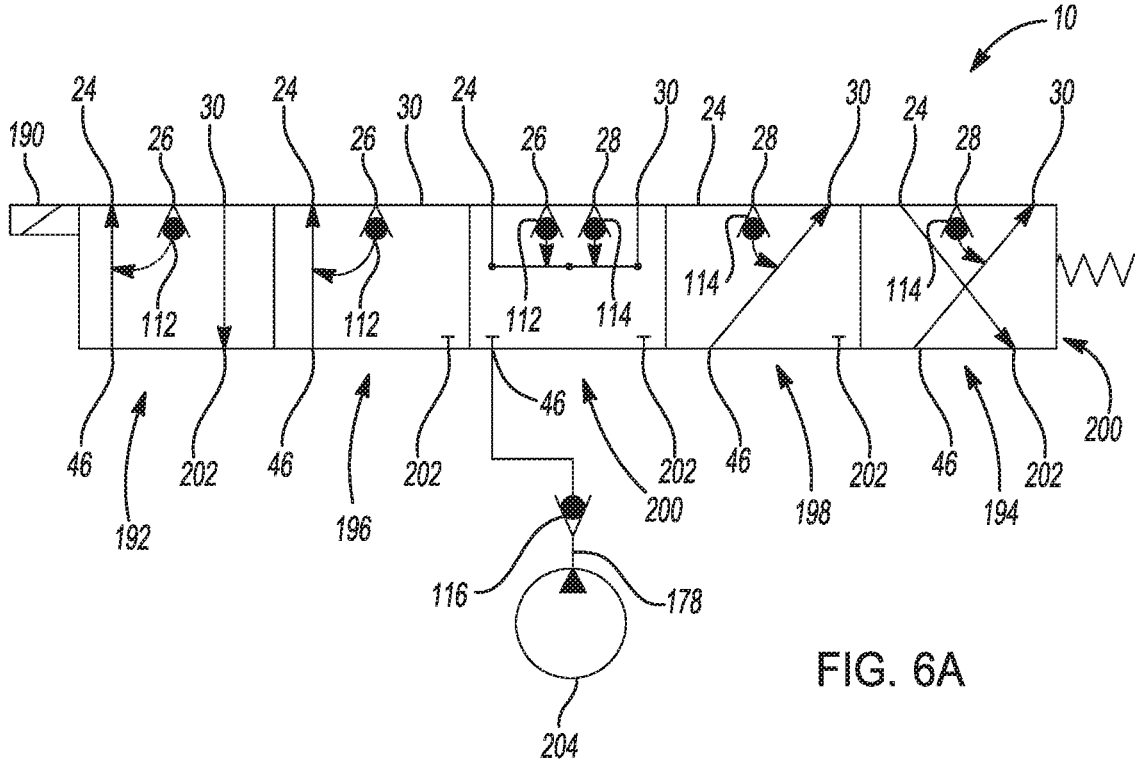
FIG. 6A is a schematic of an oil control valve functions according to the principles of the present disclosure.
Figure 6B:
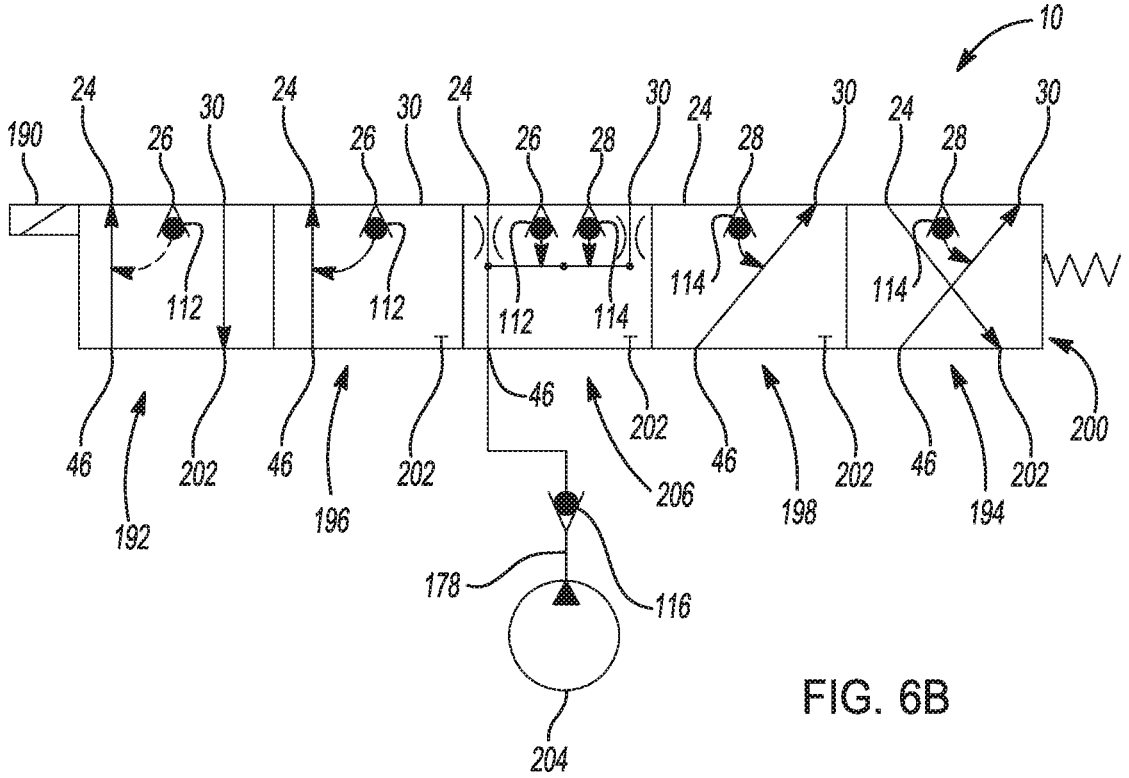
FIG. 6B is a schematic of an oil control valve functions according to the principles of the present disclosure.

The first chamber 94 communicates through the first port 78 with the central bore 82 of the spool 12 and selectively communicates with the exhaust port 104 of the valve housing 18 which empties to a sump 202 (shown in FIGS. 6A and 6B). The second chamber 98 communicates through the second port 80 with the central bore 82 of the spool 12 and selectively communicates with the first port 54 and the third port 58 of the spool guide 14. The third chamber 102 communicates in with the first port 54 and the third port 58 of the spool guide 14 when the spool 12 is in a first position. The third chamber 102 communicates with the second port 56 and the fourth port 60 of the spool guide 14 when the spool 12 is disposed in a second position. The third chamber 102 is always in communication with the fifth port 62 of the spool guide 14. A first spring 105 is disposed between the open first end 74 of the spool 12 and the first end 106 of the spool guide 14 urging the open first end 74 of the spool away from the first end 106 of the spool guide 14. A second spring 108 is disposed between the first end 110 of the recirculation housing 16 and the inlet port seat 48 urging the recirculation housing 16 away from the inlet port seat 48.

The oil control valve 10 also includes at least one first recirculation valve 112, at least one second recirculation valve 114, a third one-way valve 116, and a spacer 150. The first recirculation valve 112 is disposed within the first slot 38 of the recirculation housing 16. The first recirculation valve 112 is held in place between the valve housing 18 and the spool guide 14 and allows for one-way communication from the first end 66 of the first slot 38 to the second end 68 of the first slot 38. The first slot 38 includes a first valve lock 118 feature which, when engaged with the first recirculation valve 112 prevents the first recirculation valve 112 from opening. The second recirculation valve 114 is held in place between the valve housing 18 and the spool guide 14 and allows for one-way communication from the second end 68 of the second slot 40 to the first end 70 of the second slot 40. The second slot 40 includes a second valve lock 121 feature which, when engaged with the second recirculation valve 114 prevents the second recirculation valve 114 from opening.

The third one-way valve 116 is disposed between the inlet port seat 48 and the first end 106 of the spool guide 14. Shown in more detail in FIG. 9, the third one-way valve 116 is captured between the axial protrusion 230 of the first end 106 of the spool guide 14 and the socket portion 234 of the inlet port seat 48. The third one-way valve 116 allows for pressurized communication from the inlet pressure port 46 to the open end 44 of the third slot 42 of the recirculation housing 16 yet prevents back flow from the recirculation housing 16 to the inlet pressure port 46.

The spacer 150 of the oil control valve 10 is disposed between a second end 152 of the recirculation housing 16 and a second end 154 of the valve housing 18. In another example, the spacer 150 is integrated into the valve housing 18 during the manufacture of the valve housing 18. The spacer 150 has an axial bore 156 and at least one slot 158. The closed second end 76 of the spool is slidingly supported in the axial bore 156 of the spacer 150. The slot 158 is in communication with the first port 78 of the spool 12 to allow for selective venting of oil from the central bore 82 of the spool 12 to the sump 202. The spacer 150 also functions as a limit stop for the recirculation housing 16.

Figure 2A:
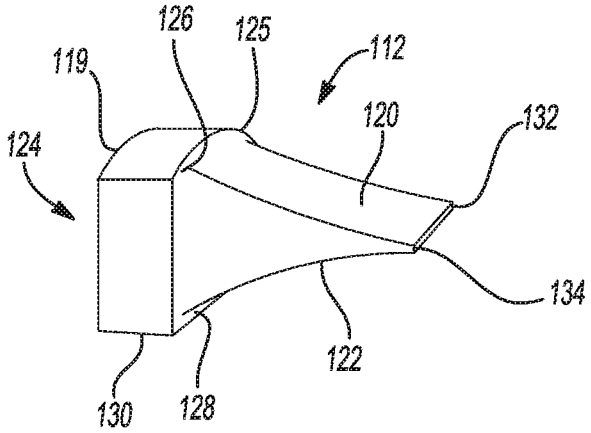
FIG. 2A is a perspective view of a selectable one-way oil valve in a closed position according to the principles of the present disclosure.
Figure 2B:
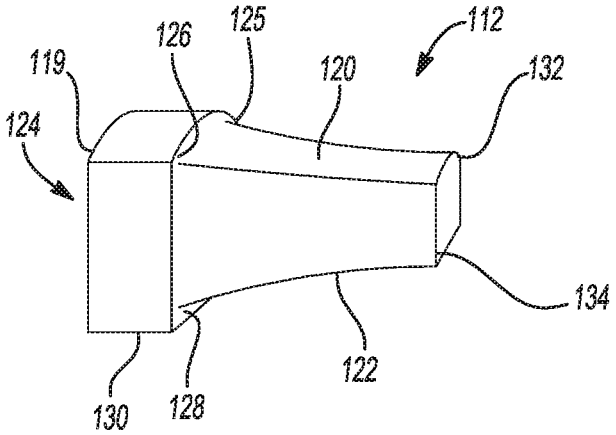
FIG. 2B is a perspective view of a selectable one-way oil valve in an open position according to the principles of the present disclosure.

Turning now to FIGS. 2A and 2B, an example of the first and second recirculation valves 112, 114 is illustrated. The recirculation valves 136 include a base portion 119 and a first and a second resilient members 120, 122. The base portion 119 has a rectangle shape forming a channel 124. The first resilient member 120 has a first end 125 extending from a first side 126 of the base portion 119 with the second resilient member 122 has a first end 128 extending from a second side 130 of the base portion 119 opposite the first side 126. A second end 132 of the first resilient member 120 selectively contacts a second end 134 of the second resilient member 122. As shown in FIG. 2A, the recirculation valve 112 is closed and does not allow for fluid flow. FIG. 2B illustrates the first and second recirculation valves 112, 114 is open allowing for fluid flow from the base portion 119, through the channel 124 and the first and second resilient members 120, 122.

Figure 4A:
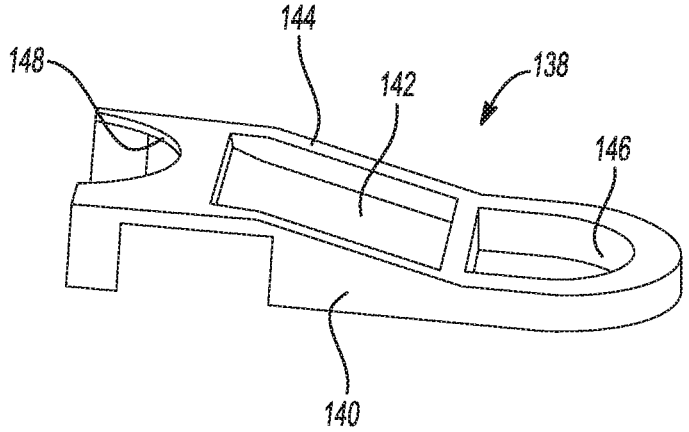
FIG. 4A is a perspective view of a selectable one-way oil valve in a closed position according to the principles of the present disclosure.
Figure 4B:
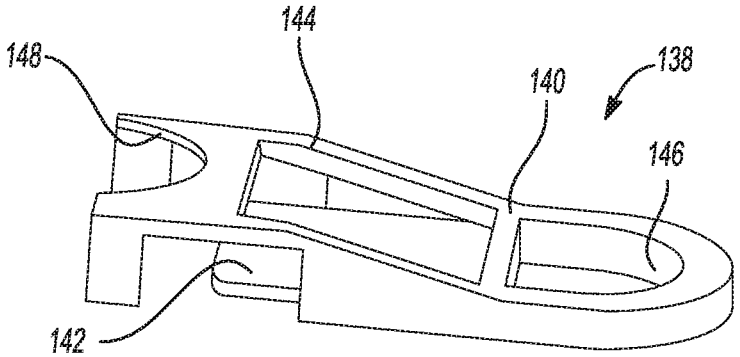
FIG. 4B is a perspective view of a selectable one-way oil valve in an open position according to the principles of the present disclosure.

Referring now to FIGS. 4A and 4B, another example of the example of the first and second recirculation valves 112, 114 is illustrated. The recirculation valve 138 includes a frame member 140 and a resilient member 142. The frame member 140 includes an angled portion 144 disposed between a first port portion 146 and a second port portion 148. The resilient member 142 is disposed in one of a first (FIG. 4A) and a second position (FIG. 4B). The resilient member 142 is urged to rest in the first position. In the first position, the resilient member 142 allows oil flow from the first port portion 146 to the second port portion 148. In the second position, the resilient member 142 blocks oil flow from the second port portion 148 to the first port portion 146.

Figure 8A:
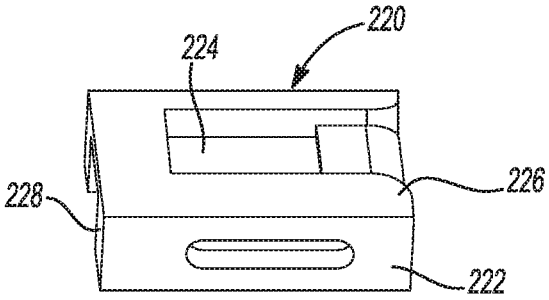
FIG. 8A is a perspective view of a selectable one-way oil valve in a closed position according to the principles of the present disclosure.
Figure 8B:
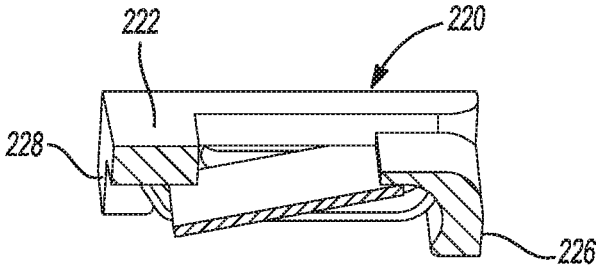
FIG. 8B is a perspective cutaway view of a selectable one-way oil valve in an open position according to the principles of the present disclosure.
Figure 8C:
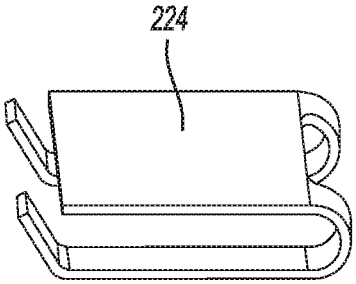
FIG. 8C is a perspective view of a portion of a selectable one-way oil valve according to the principles of the present disclosure.

Yet another example of a first and second recirculation valves 220 is illustrated in FIGS. 8A, 8B, and 8C. The recirculation valves 220 include a frame member 222 and a resilient member 224. The frame member 222 includes a flap valve member 224 disposed within the frame member 222. The flap valve member 224 is disposed in one of a first (FIG. 8A) and a second position (FIG. 8B). The flap valve member 224 is urged to rest in the second position. In the first position, flap valve member 224 prohibits oil flow from a first end 226 of the frame member 222 to a second end 228 of the frame member 222. In the second position, the flap valve member 224 allows oil flow from a first end 226 of the frame member 222 to a second end 228 of the frame member 222.

Figure 7A:
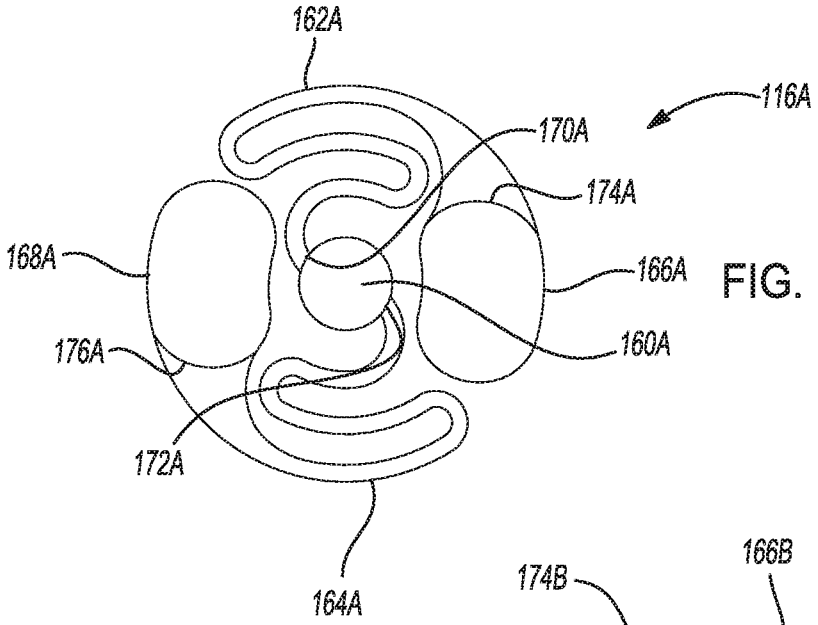
FIG. 7A is a plan view of an inlet check valve according to the principles of the present disclosure.
Figure 7B:
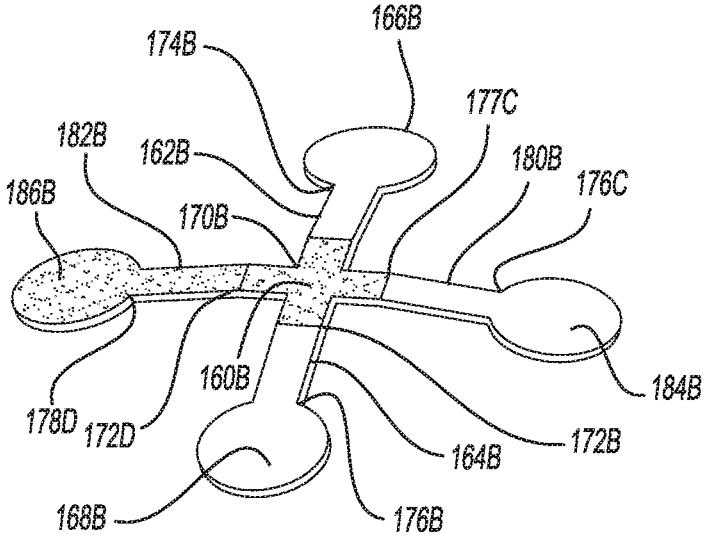
FIG. 7B is a plan view of an inlet check valve according to the principles of the present disclosure.
Figure 7C:
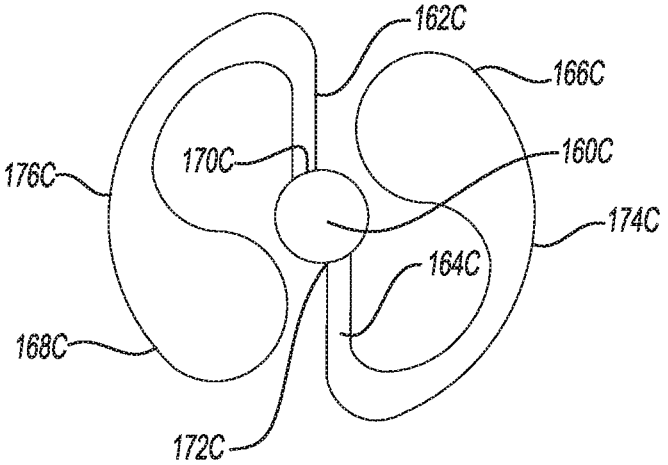
FIG. 7C is a plan view of an inlet check valve according to the principles of the present disclosure.

Turning now to FIGS. 7A, 7B, and 7C, examples of the third one-way valve 116 are illustrated. More particularly, the third one-way valve 116A shown in FIG. 7A includes a central clamp or support portion 160A, a flexible first and second support arms 162A, 164A, and a first and second port seal 166A, 168A. The support portion 160A is retained between the first end 106 of the spool guide 14 and the inlet port seat 48. A first end 170A of the first support arm 162A extends outwardly from the edge of the support portion 160A with a first end 172A of the second support arm 164A extending outwardly form the edge of the support portion 160A opposite the first support arm 162A. The first port seal 166A is disposed on a second end 174A of the first support arm 162A. The second port seal 168A is disposed on a second end 176A of the second support arm 164A. The first port seal 166A and the second port seal 168A are axially movable to cover the inlet pressure port 46 when the oil pressure in the central bore 20 of the valve housing 18 exceeds the oil pressure of the oil feed line 178 (shown in FIGS. 6A and 6B).

The third one-way valve 116B shown in FIG. 7B includes a central clamp or support portion 160B, a flexible first, second, third, and fourth support arms 162B, 164B, 180B, 182B and a first, second, third, and fourth port seals 166B, 168B, 184B, 186B. The support portion 160B is retained between the first end 106 of the spool guide 14 and the inlet port seat 48. A first end 170B of the first support arm 162B extends outwardly from the edge of the support portion 160B. A first end 172B of the second support arm 164B extends outwardly from the edge of the support portion 160B opposite the first support arm 162B. A first end 172C of the third support arm 180B extends outwardly from the edge of the support portion 160B. A first end 172D of the fourth support arm 182B extends outwardly from the edge of the support portion 160B opposite the third support arm 162B. The first port seal 166B is disposed on a second end 174B of the first support arm 162B. The second port seal 168B is disposed on a second end 176B of the second support arm 164B. The third port seal 184B is disposed on a second end 176C of the third support arm 180B. The fourth port seal 186B is disposed on a second end 178D of the fourth support arm 182B. The first port seal 166B, the second port seal 168B, the third port seal 184B, and the fourth port seal 186B are axially movable to cover the inlet pressure port 46 when the oil pressure in the central bore 20 of the valve housing 18 exceeds the oil pressure of the oil feed line 178 (shown in FIGS. 6A and 6B).

The third one-way valve 116C shown in FIG. 7C includes a central clamp or support portion 160C, a flexible first and second support arms 162C, 164C, and a first and second port seal 166C, 168C. The support portion 160C is retained between the first end 106 of the spool guide 14 and the inlet port seat 48. A first end 170C of the first support arm 162C extends outwardly from the edge of the support portion 160C with a first end 172C of the second support arm 164C extending outwardly form the edge of the support portion 160C opposite the first support arm 162C. The first port seal 166C is disposed on a second end 174C of the first support arm 162C. The second port seal 168C is disposed on a second end 176C of the second support arm 164C. The first port seal 166C and the second port seal 168C are axially movable to cover the inlet pressure port 46 when the oil pressure in the central bore 20 of the valve housing 18 exceeds the oil pressure of the oil feed line 178 (shown in FIGS. 6A and 6B).

Turning now to FIGS. 6A and 6B, examples of the functional modes of the oil control valve are illustrated and will now be described. The example shown in FIG. 6A includes each of a first through fifth modes. The modes are engaged using a solenoid 190 acting on the spool 12 of the oil control valve 10 which in turn slidingly positions the recirculation housing 16. In a first mode 192, which is one of two Oil Pressure Activated modes, the spool 12 is fully retracted toward the second end 154 of the valve housing 18. The inlet pressure port 46 is in communication with the first port 24 such that oil pressure from a pressurized oil source 204 feeds through the third one-way valve 116 into the valve housing 18 to the first port 24 of the valve housing 18. The fourth port 30 is vented to the sump 202. The second port 26 is in communication with the first port 24 through the first recirculation valve 112. In the first mode 192, the second recirculation valve 114 is forced closed by the second valve lock 121 of the recirculation housing 16.

A second mode 194, which is a second of two Oil Pressure Activated modes, the spool 12 is fully actuated toward the inlet port seat 48. The inlet pressure port 46 is in communication with the fourth port 30 such that oil pressure from a pressurized oil source 204 feeds through the third one-way valve 116 into the valve housing 18 to the fourth port 30 of the valve housing 18. The first port 24 is vented to the sump 202. The third port 28 is in communication with the fourth port 30 through the second recirculation valve 114. In the second mode 194, the first recirculation valve 112 is forced closed by the first valve lock 118 of the recirculation housing 16.

A third mode 196 is a first of two Recirculation modes. The recirculation modes are activated when the oil pressure from the pressurized oil source 204 is too low to effectively operate the oil control valve in the Oil Pressure Activated modes. In this regard, supplemental oil pressure generated by cam torsional events (twisting of the cam shaft due to valve spring loads) enters the oil control valve and is recirculated back to one of the first and fourth ports 24, 30. For example, the third mode 196 is activated by translating the spool 12 to between 0.7 mm and 1.5 mm of travel from the second end 154 of the valve housing 18 toward the inlet port seat 48. The inlet pressure port 46 is in communication with the first port 24 such that oil pressure from a pressurized oil source 204 feeds through the third one-way valve 116 into the valve housing 18 to the first port 24 of the valve housing 18. The fourth port 30, as well as all ports, is blocked from venting to the sump 202. The second port 26 is in communication with the first port 24 through the first recirculation valve 112 thus providing a recirculation path to employ the supplemental pressure generated by the cam torsional events. In the third mode 196, the second recirculation valve 114 is forced closed by the second valve lock 121 of the recirculation housing 16.

A fourth mode 198, as a second of two Recirculation modes, is activated by translating the spool 12 to between 1.8 mm and 2.6 mm of travel from the second end 154 of the valve housing 18 toward the inlet port seat 48. The inlet pressure port 46 is in communication with the fourth port 30 such that oil pressure from a pressurized oil source 204 feeds through the third one-way valve 116 into the valve housing 18 to the fourth port 30 of the valve housing 18. The first port 24, as well as all ports, are blocked from venting to the sump 202. The third port 28 is in communication with the fourth port 30 through the second recirculation valve 114 thus providing a recirculation path to employ the supplemental pressure generated by the cam torsional events. In the fourth mode 198, the first recirculation valve 112 is forced closed by the first valve lock 118 of the recirculation housing 16.

A fifth mode 200 is a Control Hold mode and is activated by translating the spool 12 to between 1.5 mm and 1.8 mm of travel from the second end 154 of the valve housing 18 toward the inlet port seat 48. The Control Hold mode allows for the cam phaser to be controlled and held at the previously commanded phase angle. The fifth mode 200, allows for the variable cam phaser to be held at the commanded phase angle. The first port 24 is in communication with the fourth port 30. The oil pressure from a pressurized oil source 204 is cut off from the first and fourth ports 24, 30. All ports 24, 26, 28, 30 are blocked from venting to the sump 202. The third port 28 is in communication with the fourth port 30 through the second recirculation valve 114 and the second port 26 is in communication with the first port 24 through the first recirculation valve 112 thus providing a recirculation path to employ the supplemental pressure generated by the cam torsional events.

Turning now to FIG. 6B, with continuing reference to FIG. 6A, a second example of a functional mode of the oil control valve is illustrated having an alternative example of a fifth mode 206. The fifth mode 206 is also a Control Hold mode and is activated by translating the spool 12 to between 1.5 mm and 1.8 mm of travel from the second end 154 of the valve housing 18 toward the inlet port seat 48. The fifth mode 200, allows for the variable cam phaser to be held at the commanded phase angle. The first port 24 is in communication with the fourth port 30. The inlet pressure port 46 is in communication with the first port 24 and the fourth port 30 such that oil pressure from a pressurized oil source 204 feeds through the third one-way valve 116 into the valve housing 18 to each of the first port 24 and the fourth port 30 of the valve housing 18. All ports 24, 26, 28, 30 are blocked from venting to the sump 202. The third port 28 is in communication with the fourth port 30 through the second recirculation valve 114 and the second port 26 is in communication with the first port 24 through the first recirculation valve 112 thus providing a recirculation path to employ the supplemental pressure generated by the cam torsional events.

While examples have been described in detail, those familiar with the art to which this disclosure relates will recognize various alternative designs and examples for practicing the disclosed structure within the scope of the appended claims.

The following is claimed:

1. An oil control valve for controlling a cam phaser, the oil control valve comprising:

a valve housing having a pressure inlet port, a first bore having a first inner surface, a first port, and a second port;

a recirculation housing having a first slot, a second slot, a second bore having a second inner surface, and a first outer surface, and wherein the recirculation housing is disposed within the first bore of the valve housing;

a spool guide having a third port, a fourth port, a fifth port, a sixth port, a seventh port, a second outer surface, a third bore having a third inner surface, a first flat surface, and a second flat surface, and wherein the spool guide is disposed within the second bore of the recirculation housing;

a spool having an eighth port and a ninth port, and wherein the spool is slidingly disposed within the third bore of the spool guide;

a first recirculation valve having a first selectable one-way member, and wherein the first recirculation valve is disposed in the first slot of the recirculation housing;

a second recirculation valve having a second selectable one-way member, and wherein the second recirculation valve is disposed in the second slot of the recirculation housing;

a one-way inlet valve disposed in the pressure inlet port; and wherein the recirculation housing and spool are each slidingly disposed to have a first, second, and third modes.

2. The oil control valve of claim 1 wherein the first slot of the recirculation housing includes a first recirculation switch, the second slot of the recirculation housing includes a second recirculation switch, the recirculation housing is disposed in a first position wherein the first recirculation switch prevents the first recirculation valve from opening, and the recirculation housing is disposed in a second position wherein the second recirculation switch prevents the second recirculation valve from opening.

3. The oil control valve of claim 1 wherein the first recirculation valve selectively provides one-way oil communication from the first port to the second port and the second recirculation valve selectively provides one-way oil communication from the second port to the first port.

4. The oil control valve of claim 1 wherein the first and second recirculation valves each include a frame member and a resilient member, and wherein the frame member includes an angled portion disposed between a first port portion and a second port portion, the resilient member is disposed in one of a first and a second position, in the first position the resilient member allows oil flow from the first port portion to the second port portion, and in the second position the resilient member blocks oil flow from the second port portion to the first port portion.

5. The oil control valve of claim 1 wherein the first and second recirculation valves each include a base portion and a first and a second resilient members, the base portion has a rectangle shape forming a channel, the first resilient member has a first end extending from a first side of the base portion, the second resilient member has a first end extending from a second side of the base portion opposite the first side, and a second end of the first resilient member selectively contacts a second end of the second resilient member.

6. The oil control valve of claim 1 wherein the first mode of the recirculation housing and the spool includes the pressure inlet port in communication with the first port, the second port in communication with a sump, and the second port in communication with the first port via the first recirculation valve, wherein the second mode of the recirculation housing and the spool includes the pressure inlet port in communication with the first port and the second port in communication with the first port via the first recirculation valve, and wherein the third mode of the recirculation housing and the spool includes the pressure inlet port in communication with the second port and the first port in communication with the second port via the second recirculation valve.

7. The oil control valve of claim 6 wherein the recirculation housing and the spool include a fourth mode including the pressure inlet port in communication with the second port, the first port in communication with the sump, and the first port in communication with the second port via the second recirculation valve.

8. The oil control valve of claim 7 wherein the recirculation housing and the spool include a fifth mode including the first port in communication with the second port via the first recirculation valve and the second port in communication with the first port via the second recirculation valve.

9. The oil control valve of claim 7 wherein the recirculation housing and the spool include a fifth mode including the pressure inlet port in communication with the first port and the second port, the first port in communication with the second port via the first recirculation valve, and the second port in communication with the first port via the second recirculation valve.

10. An oil control valve for controlling a cam phaser, the oil control valve comprising:

a valve housing having a pressure inlet port, a first bore having a first inner surface, a first port, and a second port;

a recirculation housing having a first slot, a second slot, a second bore having a second inner surface, and a first outer surface, and wherein the recirculation housing is disposed within the first bore of the valve housing;

a spool guide having a third port, a fourth port, a fifth port, a sixth port, a seventh port, a second outer surface, a third bore having a third inner surface, a first flat surface, and a second flat surface, and wherein the spool guide is disposed within the second bore of the recirculation housing;

a spool having an eighth port and a ninth port, and wherein the spool is slidingly disposed within the third bore of the spool guide;

a first recirculation valve having a first selectable one-way member, and wherein the first recirculation valve is disposed in the first slot of the recirculation housing and selectively provides one-way oil communication from the first port to the second port;

a second recirculation valve having a second selectable one-way member, and wherein the second recirculation valve is disposed in the second slot of the recirculation housing and selectively provides one-way oil communication from the second port to the first port;

a one-way inlet valve disposed in the pressure inlet port; and wherein the recirculation housing and the spool are each slidingly disposed to have a first, second, third, and fourth modes, the first slot of the recirculation housing includes a first recirculation switch, the second slot of the recirculation housing includes a second recirculation switch, the recirculation housing is disposed in a first position wherein the first recirculation switch prevents the first recirculation valve from opening, and the recirculation housing is disposed in a second position wherein the second recirculation switch prevents the second recirculation valve from opening.

11. The oil control valve of claim 10 wherein the first and second recirculation valves each include a frame member and a resilient member, and wherein the frame member includes an angled portion disposed between a first port portion and a second port portion, the resilient member is disposed in one of a first and a second position, in the first position the resilient member allows oil flow from the first port portion to the second port portion, and in the second position the resilient member blocks oil flow from the second port portion to the first port portion.

12. The oil control valve of claim 11 wherein the first and second recirculation valves each include a base portion and a first and a second resilient members, the base portion has a rectangle shape forming a channel, the first resilient member has a first end extending from a first side of the base portion, the second resilient member has a first end extending from a second side of the base portion opposite the first side, and a second end of the first resilient member selectively contacts a second end of the second resilient member.

13. The oil control valve of claim 10 wherein the first mode of the recirculation housing and the spool includes the pressure inlet port in communication with the first port, the second port in communication with a sump, and the second port in communication with the first port via the first recirculation valve, wherein the second mode of the recirculation housing and the spool includes the pressure inlet port in communication with the first port and the second port in communication with the first port via the first recirculation valve, wherein the third mode of the recirculation housing and the spool includes the pressure inlet port in communication with the second port and the first port in communication with the second port via the second recirculation valve, and wherein the fourth mode includes the pressure inlet port in communication with the second port, the first port in communication with the sump, and the first port in communication with the second port via the second recirculation valve.

14. The oil control valve of claim 13 wherein the recirculation housing and the spool include a fifth mode including the first port in communication with the second port via the first recirculation valve and the second port in communication with the first port via the second recirculation valve.

15. The oil control valve of claim 13 wherein the recirculation housing and the spool include a fifth mode including the pressure inlet port in communication with the first port and the second port, the first port in communication with the second port via the first recirculation valve, and the second port in communication with the first port via the second recirculation valve.

16. An oil control valve for controlling a cam phaser, the oil control valve comprising:

a valve housing having a pressure inlet port, a first bore having a first inner surface, a first port, and a second port;

a recirculation housing having a first slot, a second slot, a second bore having a second inner surface, and a first outer surface, and wherein the recirculation housing is disposed within the first bore of the valve housing;

a spool guide having a third port, a fourth port, a fifth port, a sixth port, a seventh port, a second outer surface, a third bore having a third inner surface, a first flat surface, and a second flat surface, and wherein the spool guide is disposed within the second bore of the recirculation housing;

a spool having an eighth port and a ninth port, and wherein the spool is slidingly disposed within the third bore of the spool guide;

a first recirculation valve having a first selectable one-way member, and wherein the first recirculation valve is disposed in the first slot of the recirculation housing and selectively provides one-way oil communication from the first port to the second port;

a second recirculation valve having a second selectable one-way member, and wherein the second recirculation valve is disposed in the second slot of the recirculation housing and selectively provides one-way oil communication from the second port to the first port;

a one-way inlet valve disposed in the pressure inlet port;

wherein the recirculation housing and the spool are each slidingly disposed to have a first, second, third, and fourth modes, the first slot of the recirculation housing includes a first recirculation switch, the second slot of the recirculation housing includes a second recirculation switch, the recirculation housing is disposed in a first position wherein the first recirculation switch prevents the first recirculation valve from opening, the recirculation housing is disposed in a second position wherein the second recirculation switch prevents the second recirculation valve from opening, wherein the first mode of the recirculation housing and the spool includes the pressure inlet port in communication with the first port, the second port in communication with a sump, and the second port in communication with the first port via the first recirculation valve, wherein the second mode of the recirculation housing and the spool includes the pressure inlet port in communication with the first port and the second port in communication with the first port via the first recirculation valve, wherein the third mode of the recirculation housing and the spool includes the pressure inlet port in communication with the second port and the first port in communication with the second port via the second recirculation valve, and wherein the fourth mode includes the pressure inlet port in communication with the second port, the first port in communication with the sump, and the first port in communication with the second port via the second recirculation valve.

17. The oil control valve of claim 16 wherein the first and second recirculation valves each include a frame member and a resilient member, and wherein the frame member includes an angled portion disposed between a first port portion and a second port portion, the resilient member is disposed in one of a first and a second position, in the first position the resilient member allows oil flow from the first port portion to the second port portion, and in the second position the resilient member blocks oil flow from the second port portion to the first port portion.

18. The oil control valve of claim 16 wherein the first and second recirculation valves each include a base portion and a first and a second resilient members, the base portion has a rectangle shape forming a channel, the first resilient member has a first end extending from a first side of the base portion, the second resilient member has a first end extending from a second side of the base portion opposite the first side, and a second end of the first resilient member selectively contacts a second end of the second resilient member.

19. The oil control valve of claim 16 wherein the recirculation housing and the spool include a fifth mode including the first port in communication with the second port via the first recirculation valve and the second port in communication with the first port via the second recirculation valve.

20. The oil control valve of claim 16 wherein the recirculation housing and the spool include a fifth mode including the pressure inlet port in communication with the first port and the second port, the first port in communication with the second port via the first recirculation valve, and the second port in communication with the first port via the second recirculation valve.

* * * * *